US010792804B2

(12) United States Patent
Anile

(10) Patent No.: US 10,792,804 B2
(45) Date of Patent: Oct. 6, 2020

(54) STRUCTURE FOR AN ORGANIZED CONTAINER, PARTICULARLY FOR HYDRAULIC CONNECTORS AND SIMILAR

(71) Applicant: Francesco Anile, Chiavari (IT)

(72) Inventor: Francesco Anile, Chiavari (IT)

( * ) Notice: Subject to any disclaimer, the term of this patent is extended or adjusted under 35 U.S.C. 154(b) by 162 days.

(21) Appl. No.: 16/070,313

(22) PCT Filed: Dec. 14, 2016

(86) PCT No.: PCT/EP2016/002106
§ 371 (c)(1),
(2) Date: Jul. 16, 2018

(87) PCT Pub. No.: WO2017/129210
PCT Pub. Date: Aug. 3, 2017

(65) Prior Publication Data

US 2019/0039232 A1 Feb. 7, 2019

(30) Foreign Application Priority Data

Jan. 25, 2016 (IT) ..... 202016000006700

(51) Int. Cl.
*B25H 3/02* (2006.01)
*B65D 25/10* (2006.01)
*B65D 25/54* (2006.01)

(52) U.S. Cl.
CPC ..... *B25H 3/022* (2013.01); *B25H 3/02* (2013.01); *B65D 25/10* (2013.01); *B65D 25/54* (2013.01)

(58) Field of Classification Search
CPC ..... B25H 3/021; B25H 3/02; B65D 25/10; B65D 25/107; B65D 25/54; B65D 25/56; B65D 2585/54; B65D 2585/64; B65D 2585/649
USPC ..... 206/782; 211/70.4, 94.01
See application file for complete search history.

(56) References Cited

U.S. PATENT DOCUMENTS

| | | | | |
|---|---|---|---|---|
| 1,523,136 | A * | 1/1925 | O'Connor | B25H 3/06 220/533 |
| 2,139,293 | A | 12/1938 | Wallgren | |
| 4,706,805 | A * | 11/1987 | Becher | B65D 5/46008 206/144 |
| 4,819,800 | A | 4/1989 | Wilson | |
| 9,380,915 | B2 * | 7/2016 | Sabounjian | A47J 31/3642 |
| 2006/0108246 | A1 | 5/2006 | Chen | |
| 2007/0246434 | A1 * | 10/2007 | Adams | A47F 5/01 211/8 |

(Continued)

FOREIGN PATENT DOCUMENTS

| | | | |
|---|---|---|---|
| DE | 29807230 | U1 | 7/1998 |
| EP | 0005627 | A2 | 11/1979 |
| EP | 2944437 | A1 | 11/2015 |

*Primary Examiner* — Mollie Impink
(74) *Attorney, Agent, or Firm* — Richard M. Goldberg

(57) ABSTRACT

Structure for an organised container, particularly for hydraulic connectors and similar, including a prismatic boxed body made up of side walls joined to a bottom and defining an internal space; the internal part of the walls includes supporting elements suitable to hold a plurality of connectors, subdivided by type, in an organised way, such that the organisation of the parts in the container, immediate determination of the type and number of the connectors present, as well as the ease of removal, facilitates supply in the warehouse and work on the construction site.

4 Claims, 2 Drawing Sheets

(56) References Cited

U.S. PATENT DOCUMENTS

| | | | | |
|---|---|---|---|---|
| 2007/0295627 | A1 | 12/2007 | Hsieh | |
| 2008/0023424 | A1* | 1/2008 | Sudholt | A47F 5/0846 211/85.29 |
| 2012/0312812 | A1* | 12/2012 | Sosnovsky | B25H 3/021 220/23.83 |
| 2014/0069841 | A1 | 3/2014 | Pizzato et al. | |

* cited by examiner

STRUCTURE FOR AN ORGANIZED CONTAINER, PARTICULARLY FOR HYDRAULIC CONNECTORS AND SIMILAR

BACKGROUND OF THE INVENTION

This model refers to a structure for an organised container, particularly for hydraulic connectors and similar.

As well-known, the installers of a hydraulic plant send to the construction site a series of parts to be used for the various needs among which are connectors.

Normally, in order to be able to tackle any need for installation, the operator brings a large number of connectors of different types, usually gathered in bulk in a container.

This way of operating presents several inconveniences.

A first inconvenience is due to the fact that the operator has to look for the part needed among the numerous pieces contained in bulk in the container and therefore the identification and the selection of the chosen connector is a long and laborious operation.

Another important inconvenience is due to the fact that the operator has first to go to the site of installation and then ensure that the container contains all the necessary connectors by type and by number.

This preliminary operation is extremely laborious and subject to error, so the operator often finds himself in the condition of acquiring fewer connectors than necessary or of buying more with the risk of them remaining unused, with evident economic repercussions.

SUMMARY OF THE INVENTION

The task of this invention is indeed to create a structure of organised container, particularly for hydraulic connectors and similar, which solves the problems of the well-known technique mentioned above.

Under the scope of this task, one purpose of the invention is that of creating a structure for a container that is an efficient, innovative, practical and above all, extremely functional product.

Another purpose is that of creating a structure for a container that is able to facilitate the work of installation guaranteeing the maximum order of the parts and easy and simple removal.

A further purpose of the invention is that of creating a structure for a container that allows the operator to immediately identify the type and the exact number of the hydraulic connectors present in the container itself.

Another purpose is that of creating a structure for a container which allows easy supply in the warehouse and easy work on the construction site.

A further purpose of the invention is that of creating a structure for a container that allows a reduction of the general costs, avoiding the operator buying a quantity of connectors that corresponds little to his real needs.

Another purpose of the invention is that of creating a structure which, due to its peculiar characteristics of assembly, is able to ensure the widest guarantees of reliability and safety in use.

This task, and others that will appear better in the following, are reached by an organised structure of container, particularly for hydraulic connectors and similar, comprising a prismatic boxed body made up of side walls joined to a bottom and defining an internal space; said structure for a container being characterised by the fact that the internal part of said walls includes supporting means suitable to hold a plurality of parts in an organised way.

BRIEF DESCRIPTION OF THE DRAWINGS

Further features and advantages will result more clearly from the description of the structure according to this invention illustrated as an example and not limited to the attached drawings, in which.

DETAILED DESCRIPTION

Figure 1:
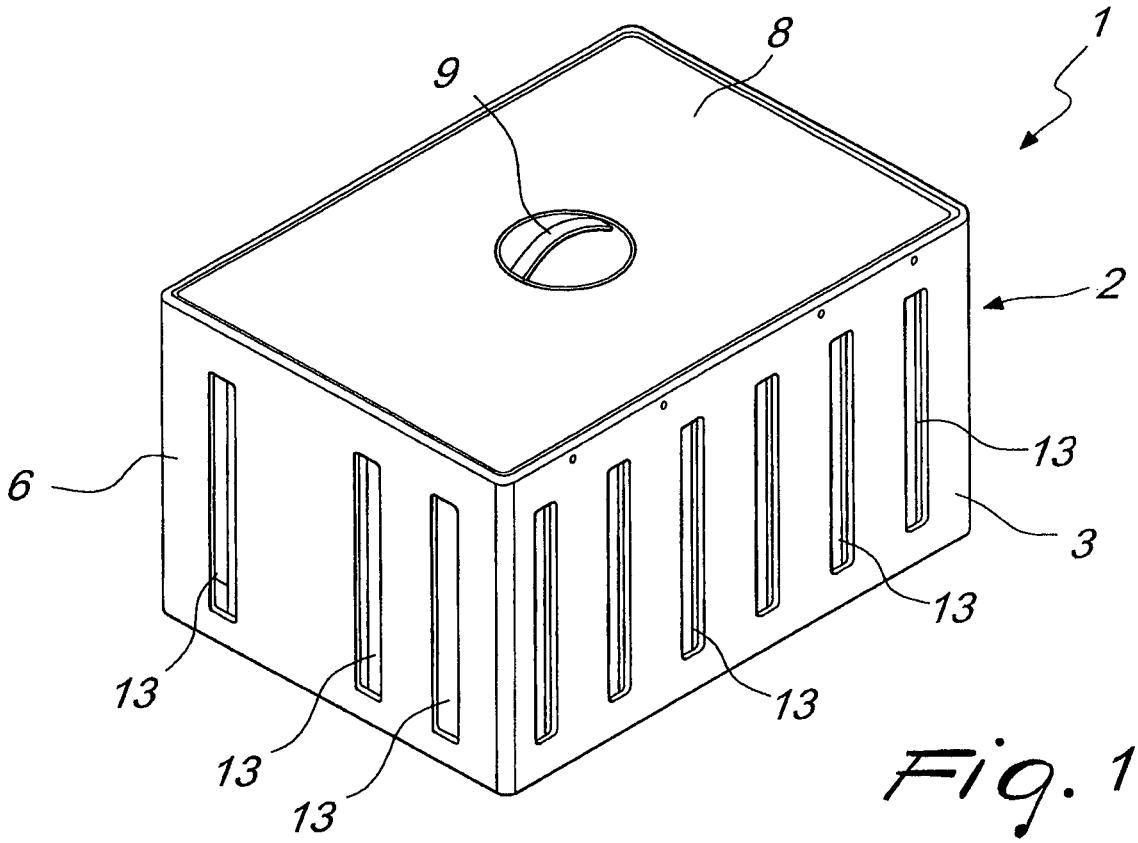
FIG. 1 is the perspective view of the container according to this invention.
Figure 2:
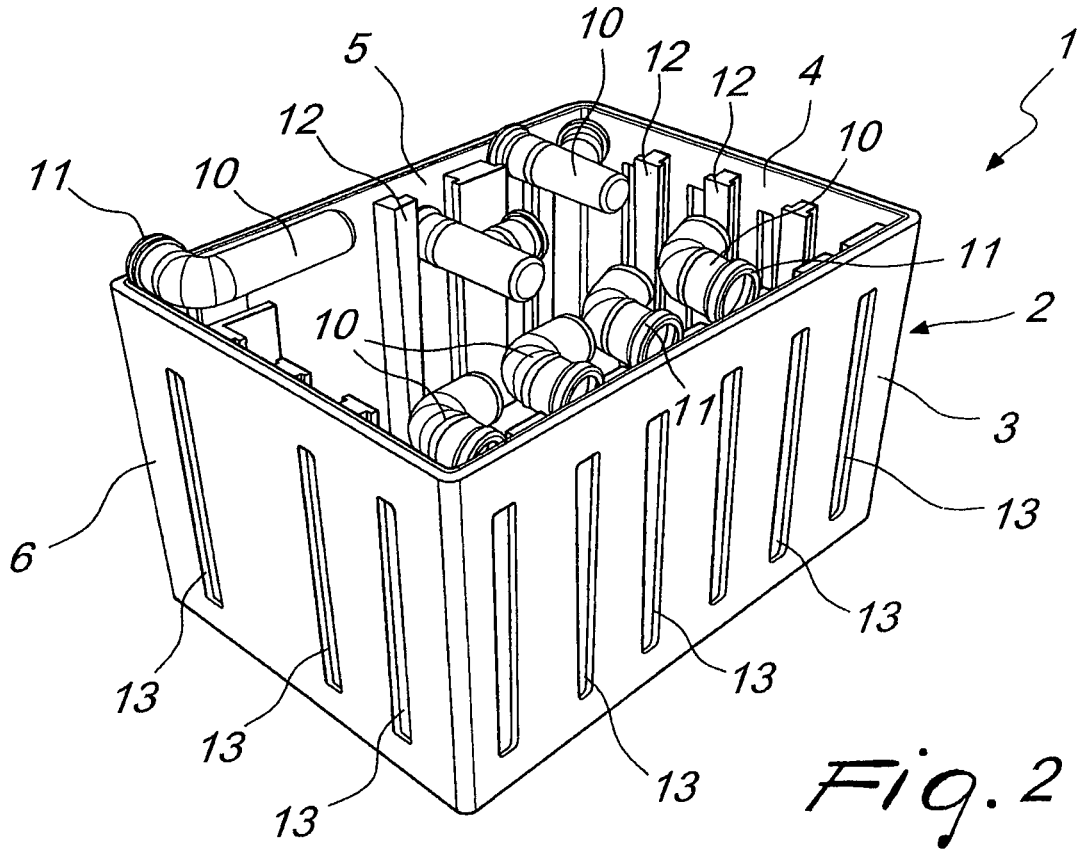
FIG. 2 is the perspective view of the container, without the lid.
Figure 3:
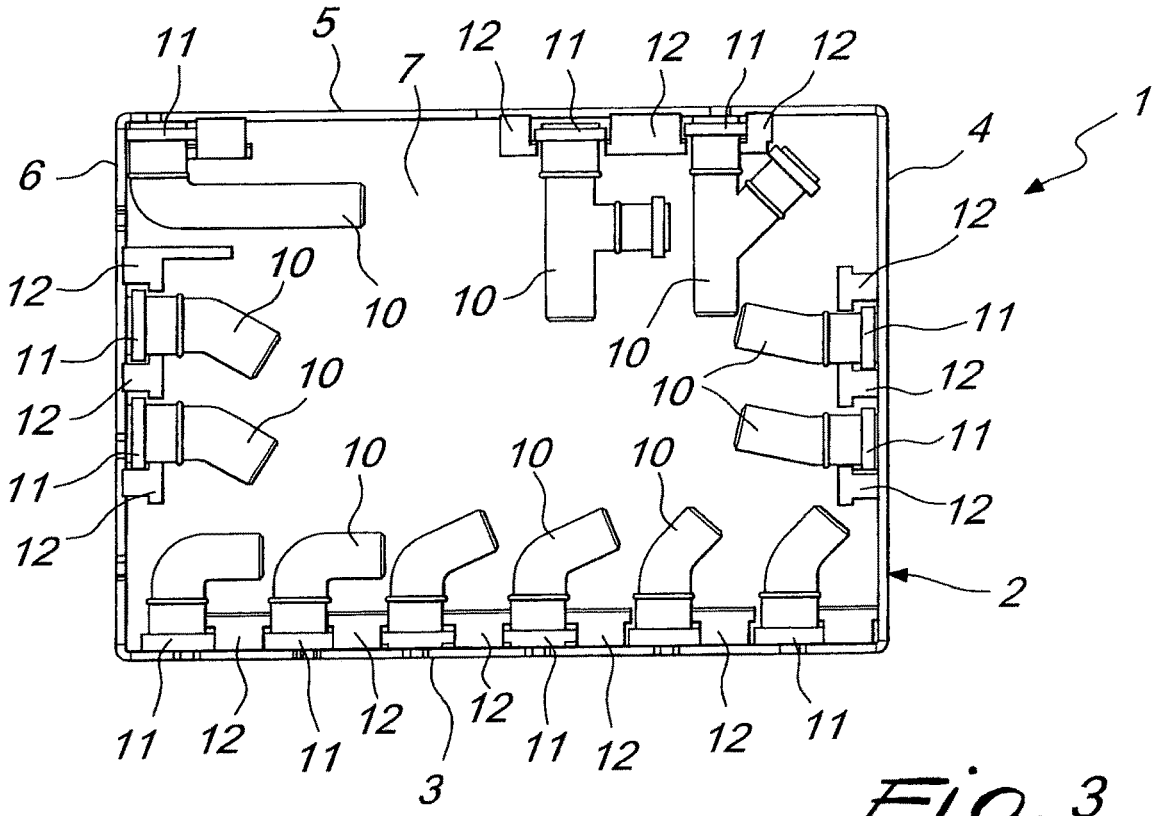
FIG. 3 is a plan view of the container.
Figure 4:
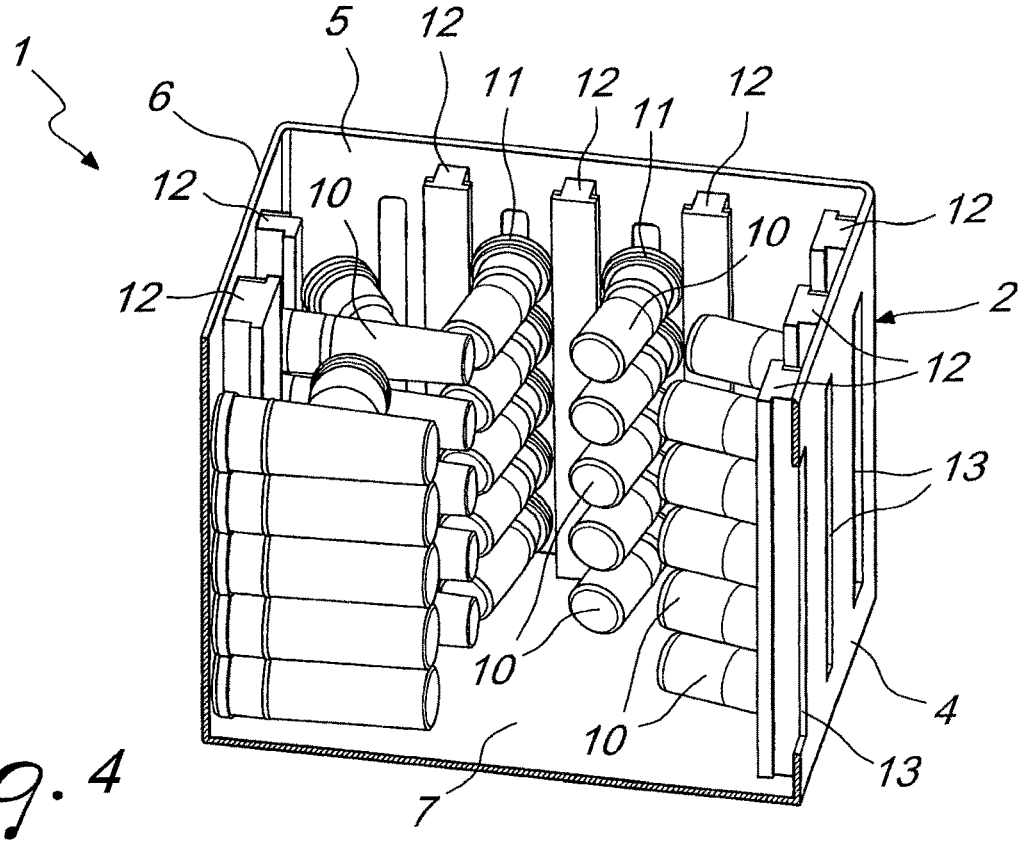
FIG. 4 is a perspective view, in cross-section, of the container.

With reference to the figures mentioned, the structure for the container according to this invention, indicated globally with the reference number 1, includes a boxed body 2, preferably of prismatic shape, made up of four side walls, indicated with the reference numbers 3, 4, 5, and 6, together with a bottom 7 defining an internal space.

The upper part of the boxed body can be closed with a lid 8 fitted with a handle 9, or another gripping element.

According to this invention, the internal part of the container is fitted with supporting means suitable to hold a plurality of parts 10 in an organised way. In this particular case the parts 10 are made up of hydraulic connectors which include a flanged portion 11 susceptible to being held by the supporting means.

The supporting means are advantageously made up of a series of contoured shapes 12 having a T-shape cross-section and fixed in the internal part of the walls, in such way as to define a plurality of guides suitable to receive the flanged portions 11 of the connectors 10.

Advantageously, the T-shaped contours are sized and separated one from the other in such way as to form guides of different sizes, specific for each type of connector.

Advantageously, the walls 3, 4, 5 and 6 are fitted with windows 13 made up of elongated openings that extend in correspondence with the guides in such way as to allow one to inspect the content from the outside, without opening the container, and to determine immediately the number of connectors present in each section.

For this purpose, the windows 13 are advantageously fitted with graduated scales which allow one to identify immediately the precise number of parts present for each section.

Advantageously, each internal guide can house a series of parts of the same type in such way as to allow the user to immediately identify the part required and easily remove one from the container for use.

Furthermore, at the top of each graduated scale an identification code is indicated for the connector present in the respective guide, so as to immediately identify the model and the number of parts present for said model.

The identification code may be made up, for instance, either by the radius of curvature of the connector, in degrees, or by any other recognition code.

It has been shown how this invention reaches its purposes having created a container for hydraulic connectors which offers various advantages.

The container structure according to this invention markedly facilitates the work of the installer guaranteeing maximum order for the parts to be used in that, thanks to the internal contours with specific cross-sections, it is possible to stack the connectors of various gradations in an orderly way.

The guides offer great practicality for use since, stacking the connectors, it is possible to extract them easily.

Furthermore, the openings and the numerical scales around the external perimeter of the container allow one to see the exact number of hydraulic connectors present in the container guaranteeing a perfect organisation of the work.

This structure for a container also offers greater overall efficiency of work in that the easy extraction of the parts and knowledge of the quantity of connectors facilitates supply from the warehouse and the work on the construction site.

This structure for a container also allows better cost-effectiveness of the work in that, knowing exactly the number and type of connectors present, one avoids purchasing fewer connectors than necessary or buying too many, with the risk of leaving them unused.

The cost-effectiveness that ensues, together with the advantages mentioned above, make this container an efficient, innovative, practical and above all extremely functional product.

Naturally, the materials and the dimensions can vary, according to the needs and the state of the art.

What is claimed is:

1. Structure for an organized container for holding hydraulic connector pipes of different sizes and shapes and each hydraulic connector pipe including a flanged portion, comprising:

a prismatic boxed body made up of side walls joined to a bottom and defining an internal space;

the side walls have an internal surface which includes a supporting arrangement suitable to hold a plurality of the hydraulic connector pipes in an organized way;

said supporting arrangement comprises a series of contoured shapes, each having a T-shaped cross-section and fixed at the internal surface of said walls, the T-shaped contour shapes being arranged in pairs secured to the internal surface of the side walls, with a widthwise spacing between the T-shaped contour shapes of each said pair defining a guide adapted to receive a plurality of flanged portions of stacked hydraulic connector pipes in said guide, with the widthwise spacing of the guide between at least one said pair of T-shaped contour shapes being different from the widthwise spacing of the guides of at least one other pair of said T-shaped contour shapes;

said side walls comprise windows with elongated openings that extend in alignment with said guides in such way as to allow one to inspect a content of the container from the outside, and each of said windows includes a graduated scale that allows one to identify a precise number of hydraulic connector pipes present for each guide.

2. Structure as per claim 1, wherein an upper part of said boxed body is adapted to be closed off with a lid fitted with a gripping element.

3. Structure, as per claim 1, wherein said T-shaped contoured shapes are sized to form T-shaped contoured shapes of different sizes specific for each type of hydraulic connector pipe.

4. Structure, as per claim 1, wherein said graduated scales each include, at a summit thereof, an identification code suitable to identify a model of the hydraulic connector pipes present in each of said guides.

* * * * *